United States Patent [19]

Drucker et al.

[11] Patent Number: 4,476,920

[45] Date of Patent: Oct. 16, 1984

[54] METHOD AND APPARATUS FOR INTEGRATING OPERATION OF A HEAT PUMP AND A SEPARATE HEATING SOURCE

[75] Inventors: Alan S. Drucker, Dewitt; Richard D. D'Aversa, Liverpool; Richard D. Jeffers, N. Syracuse, all of N.Y.

[73] Assignee: Carrier Corporation, Syracuse, N.Y.

[21] Appl. No.: 394,578

[22] Filed: Jul. 2, 1982

[51] Int. Cl.[3] ..... F25B 29/00

[52] U.S. Cl. ..... 165/29; 62/324.1; 237/2 B

[58] Field of Search ..... 165/17, 29; 62/151, 62/155, 156, 160, 324.1; 237/2 B

[56] References Cited

U.S. PATENT DOCUMENTS

| | | | |
|---|---|---|---|
| 3,103,794 | 9/1963 | Kyle et al. | 165/29 |
| 3,318,372 | 5/1967 | Shell | 165/29 |
| 3,627,031 | 12/1971 | Ware . | |
| 3,989,183 | 11/1976 | Gustafsson . | |
| 3,996,998 | 12/1976 | Garst et al. . | |
| 4,052,001 | 10/1977 | Vogt . | |
| 4,102,389 | 7/1978 | Wills | 62/160 |
| 4,102,390 | 7/1978 | Harnish et al. . | |
| 4,143,707 | 3/1979 | Lewis et al. . | |
| 4,147,203 | 4/1979 | Rayfield | 165/29 |
| 4,178,988 | 12/1979 | Cann et al. . | |
| 4,191,023 | 3/1980 | Sisk et al. . | |
| 4,271,899 | 6/1981 | Noland | 62/160 |
| 4,311,190 | 1/1982 | Walley | 165/29 |

OTHER PUBLICATIONS

Carrier Publication, "Installation and Instructions 38CQ, RQ, HQ Optimizer II Accessory Control.

*Primary Examiner*—William R. Cline
*Assistant Examiner*—John M. Kramer
*Attorney, Agent, or Firm*—Robert P. Hayter

[57] ABSTRACT

A method and apparatus for integrating operation of a heat pump and a separate heating source are disclosed. The combination of a heating lockout relay and an interlock relay are utilized to provide for fail safe integrated operation including providing for selected control functions and for isolating other functions to prevent a failed electrical component from operating the system in an undesirable manner.

9 Claims, 2 Drawing Figures

METHOD AND APPARATUS FOR INTEGRATING OPERATION OF A HEAT PUMP AND A SEPARATE HEATING SOURCE

BACKGROUND OF THE INVENTION

1. Field of the Invention

The present invention relates to a control system for use in supplying conditioned air to an enclosure. More particularly, the present invention relates to a control system for co-ordinately synchronizing a heat pump and a furnace to provide conditioned air to an enclosure.

2. Description of the Prior Art

It has been determined that a heat pump is capable of supplying sufficient quantities of heat energy to meet many residential and commerical heating applications even in northern climates. The use of a heat pump to transfer heat energy from an area where loss of heat is not important, such as the outdoor ambient, to an area where the heat energy is required is a very efficient method of heating an enclosure under the appropriate circumstances. Many heat pumps commercially available are capable of transferring up to two or three times the amount of heat energy from one area to another as would be generated using an equivalent amount of electricity for electrical resistance heating. The heat pump having a high co-efficient of performance may be more efficient than a fuel fired furnace under appropriate heating conditions and with proper use resulting in overall energy usage savings.

Heat pumps are, however, limited in overall application since for a heat pump to operate it must be capable of removing heat energy from one area and transferring that heat energy to the area or enclosure to be heated. Heat pumps of modern day design are capable of performing this operation at temperatures well below 0° F. while performing more efficiently than electrical resistance heating. However, when operating at extremely cold temperatures the heat pump is much less efficient and transfers a reduced amount of heat energy. Under these conditions, it may be appropriate to operate a fossil fuel fired furnace which would be more efficient and would be capable of supplying additional heat energy as may be needed to condition the enclosure.

Heat pumps also have the disadvantage that when the refrigerant in the outdoor coil is being evaporated to absorb heat from the ambient air, the air adjacent to the coil is cooled below the freezing point and as it is cooled, the moisture in the air is precipitated onto the outdoor coil surface resulting in frost or ice buildup thereon. The frost buildup becomes an insulating layer further decreasing the ability of the heat pump to transfer heat energy.

It has been found that below certain outdoor temperatures it is both economical and advantageous to use conventional furnace type or boiler heating to supply heat energy to an enclosure. This may include the use of electrical resistance heat or conventional gas, oil or coal fired furnace or the use of a boiler fired by any one of these fuels. The point at which it is desirable to switch from the use of the heat pump to the use of the alternate heating source is called the balance point. This point may be chosen either based on the economics of operating the heat pump versus the furnace or may be chosen on the basis of the capability of the heat pump for supplying sufficient heat energy to maintain the temperature of the enclosure.

Many heat pumps are combined with existing gas or oil furnaces in a residential application to provide an improved conditioning system. Many homes had gas or oil furnaces installed as-original equipment. To provide air conditioning to these homes a refrigeration circuit including indoor and outdoor coils is typically arranged with the indoor coil located in the duct work between the enclosure and the furnace. In lieu of such an air conditioning system it is a simple matter to install a heat pump in place of the air conditioner such that not only will cooling be provided during the cooling season but that heating will be available from the heat pump when desired. By utilizing the heat pump it is possible to obtain efficiencies available by utilizing the heat pump when it is more efficient to operate the heat pump and to utilize the existing furnace when it is more efficient to operate the furnace. In addition, the availability of the furnace provides a source of economical heat energy to supply to the enclosure during defrost of the heat pump to further provide an economical combined system.

Control systems have become commercially available for integrating the operation of a heat pump and a furnace. The herein described method and apparatus specifically concerns the integration of multiple relay means to provide for fail safe operation should a component of the system fail. A heating lockout relay is utilized to prevent operation of the furnace if heat pump operation in the cooling mode is desired. The heating lockout relay is also utilized during the defrost mode when the heat pump is operating and includes contacts normally open preventing furnace boiler operation which close to provide for furnace boiler operation during defrost conditions. The utilization of the heating lockout relay in this application provides for fail safe operation such that should the defrost relay fail, a furnace boiler relay will not be energized unless the heating lockout relay is likewise energized. Additionally, a blower pump relay may be energized when the heating lockout relay is energized but not when the furnace boiler relay is energized such that a control system is provided for allowing the boiler pump relay to be energized when the heat pump is operated but not when the furnace boiler is operated. When the furnace boiler is operated separate circuitry of the furnace boiler is utilized to control fan or pump operation. This system combination allows for multiple fan speed operation and for delays in fan operation when switching between the heat pump mode of operation and the furnace mode of operation.

An interlock relay is also utilized having interlock relay contacts which, when closed, act to maintain the interlock relay energized such that a circuit is maintained through an outdoor thermostat holding the interlock relay energized until both the first and second stages of heating are satisfied. The interlock relay further has contacts for locking out a high temperature switch which would prevent heat pump operation during furnace operation. Additionally, the interlock relay has contacts arranged to connect the furnace boiler relay to a power source to energize the furnace or boiler upon the interlock relay being energized.

Hence, as may be further seen herein, the combination of relays provide for safe operation of an integrated system such that should various components fail operation will still be maintained in a safe and orderly manner throughout the control system.

SUMMARY OF THE INVENTION

It is an object of the present invention to provide an improved efficient, and reliable combination heat pump and furnace system for conditioning air to an enclosure.

It is another object of the present invention to provide a heating system effectively combining a furnace with a heat pump.

It is another object of the present invention to provide a heating lockout relay in combination with a heat pump and an alternate heating means system for preventing operation of components of the system upon failure of other components and for serving other purposes such as energizing the furnace or alternative heating means upon the unit being placed in the defrost mode.

It is another object of the present invention to provide an interlock relay for maintaining alternative heating source means energized once initially energized until all heating needs are satisfied.

It is another object of the present invention to provide a control mechanism for installation with an existing furnace and an add on heat pump for synchronously controlling the operation of both.

It is a further object of the present invention to provide a combination heat pump and furnace system wherein a high temperature switch for discontinuing furnace operation is isolated via an interlock relay during the second stage heating mode of operation.

It is a yet further object of the present invention to provide a combination heat pump and furnace wherein a high temperature switch discontinues operation of both the heat pump and furnace if simultaneous operation of both heat sources is detected.

It is a still further object of the present invention to provide a safe, economical and reliable control circuit and method for integrating operation of a furnace with a heat pump system under various conditions.

Other objects will be apparent from the description to follow and from the appended claims.

The preceding objects are achieved according to a preferred embodiment of the invention by the provision of a control circuit for integrating and separating the operation of a heat pump including heating and defrost modes of operation and a separate heating means. The separate heating means includes a circulator for circulating heating fluid and the control circuit includes a thermostat for sensing heating and cooling needs and an outdoor thermostat for selecting either the heat pump or the separate heating means for supplying heat energy to a space to be conditioned. A heating lockout relay is connected to be energized when the thermostat senses a cooling need or when the unit is operating in the defrost mode of operation for preventing inadvertent operation of the separate heating means. A furnace boiler relay is connected to be energized in response to the thermostat sensing a first stage heating need and the outdoor thermostat selecting furnace boiler operation and the heating lockout relay not being energized. A circulator relay (blower pump relay) connected to a fan energization switch of the thermostat is energized either when the furnace boiler relay is not energized or when the heating lockout relay is energized such that the circulator relay is energized with the energization of the heat pump and not energized with the operation of the separate heating means. An interlock relay may be connected through normally closed heating lockout relay contacts to the thermostat means such that the interlock relay may be energized upon the thermostat detecting a second stage heating need and the heating lockout relay not being energized.

The method of integrating the operation of the heat pump including a compressor and having heating and defrost modes of operation and a separate heating means to provide for fail safe separation of the separate heat sources is disclosed. The separate heating means includes a circulator for circulating heating fluid to the enclosure to be conditioned. A thermostat for sensing heating and cooling needs and an outdoor thermostat for selecting either the heat pump or the separate heating means for supplying heat energy to a space to be conditioned are also provided. The method includes energizing a heating lockout relay when a thermostat senses a cooling need for the space to be conditioned, energizing the heating lockout relay when the heat pump is operated in the defrost mode of operation, the step of energizing the heating lockout relay including preventing the furnace boiler relay from being energized through the outdoor thermostat upon a detection of a first stage heating need when the ambient temperature is below a predetermined level such that the compressor of the heat pump is operated and the separate heating means is not operated. The step of energizing the heating lockout relay includes connecting a circulator relay for energizing the circulator of the separate heating means to a fan switch in the thermostat and the step of energizing the heating lockout relay including connecting defrost means to the furnace boiler relay for energizing the furnace boiler during the defrost mode of operation.

DESCRIPTION OF THE PREFERRED EMBODIMENT

The embodiment of the invention described below is adapted for use with a heat pump in combination with alternative heating means. Alternative heating means may be a furnace for heating air fired by oil, natural gas, coal or electricity. In such a case, a fan relay energizes a fan for circulating air over a heat exchanger such that the air is heated. The alternative heating means may also be a boiler for heating water utilizing any of the heat sources listed above for a furnace. In such case, instead of a fan a circulating pump is utilized to circulate water throughout the enclosure to be conditioned. This circulating pump may be referred to either as a pump or a circulator. It is further to be understood that this control system may be utilized as part of a new installation of a furnace and a heat pump into an enclosure or is adapted to be added to an existing furnace with the addition of a heat pump to effect integrated operation.

Figure 1:
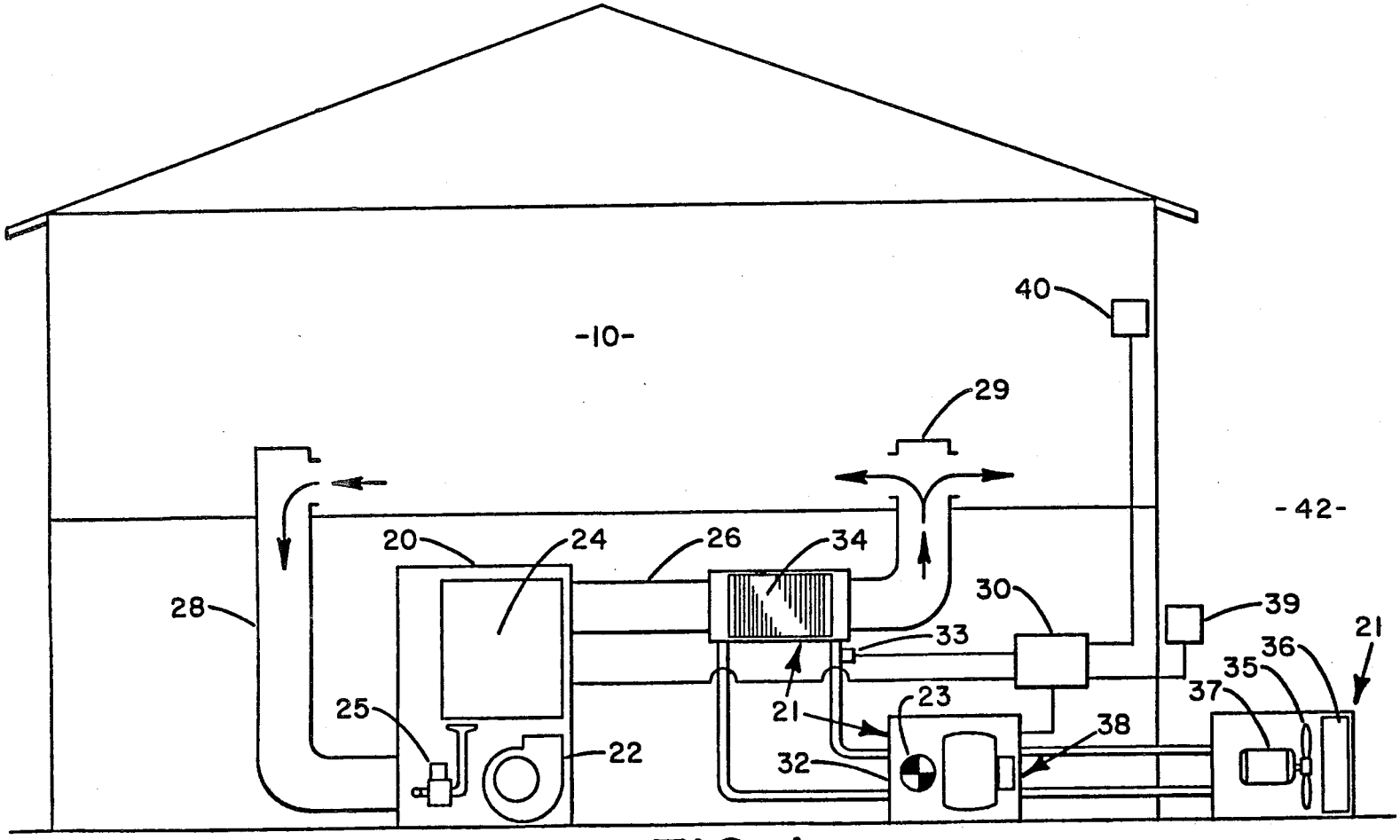
FIG. 1 is a plan view of an enclosure incorporating a combination heat pump and furnace for supplying conditioned air to the enclosure.

Referring to FIG. 1 there may be seen a plan view of enclosure 10. Furnace 20 is mounted such that cold air from the enclosure is received by the furnace through cold air return 28 and thereafter conditioned air from the furnace is supplied to the enclosure through supply duct 26 and hot air supply 29. The furnace has furnace blower or fan 22 for circulating air from the enclosure through the cold air return to the furnace through the furnace heat exchangers 24, through supply duct 26 and back to the enclosure through hot air supply 29. Gas valve 25 for supplying heating fuel to the heat exchangers 24 is additionally shown.

It can also be seen in FIG. 1 that heat pump 21 is mounted such that indoor coil 34 is located within supply duct 26 in communication with the enclosure air being circulated by the furnace blower and that outdoor coil 36 is mounted outside the enclosure in communication with ambient air 42. Indoor coil 34 and outdoor coil 36 are connected to compressor unit 38. Outdoor fan 35 which is powered by outdoor fan motor 37 is located such that ambient air is circulated through outdoor coil 36. High temperature sensor 33 is shown mounted on the connecting line between indoor coil 34 and compressor unit 38. This connecting line is the compressor discharge line to the indoor coil when the heat pump is in the heating mode of operation. Hence, when the heat pump is in the heating mode, refrigerant flows from the compressor unit to the indoor coil in heat exchange relation with high temperature sensor 33. In the cooling mode of operation, refrigerant flows from the compressor to the outdoor coil where it is condensed and then is conducted through an interconnecting line to the indoor heat exchanger. The refrigerant then flows from the indoor heat exchanger in heat exchange relation with high temperature sensor 33 back to the compressor unit. In the cooling mode of operation the indoor coil serves as the evaporator of the refrigeration circuit and the line with the high temperature sensor is the compressor suction line.

It can also be seen in FIG. 1 that control box 30 is arranged to integrate the controls of the furnace blower and gas valve, with compressor unit 38 and is connected to indoor thermostat 40, to outdoor thermostat 39, to high temperature sensor 33 and otherwise as is needed to integrate the entire system.

Figure 2:
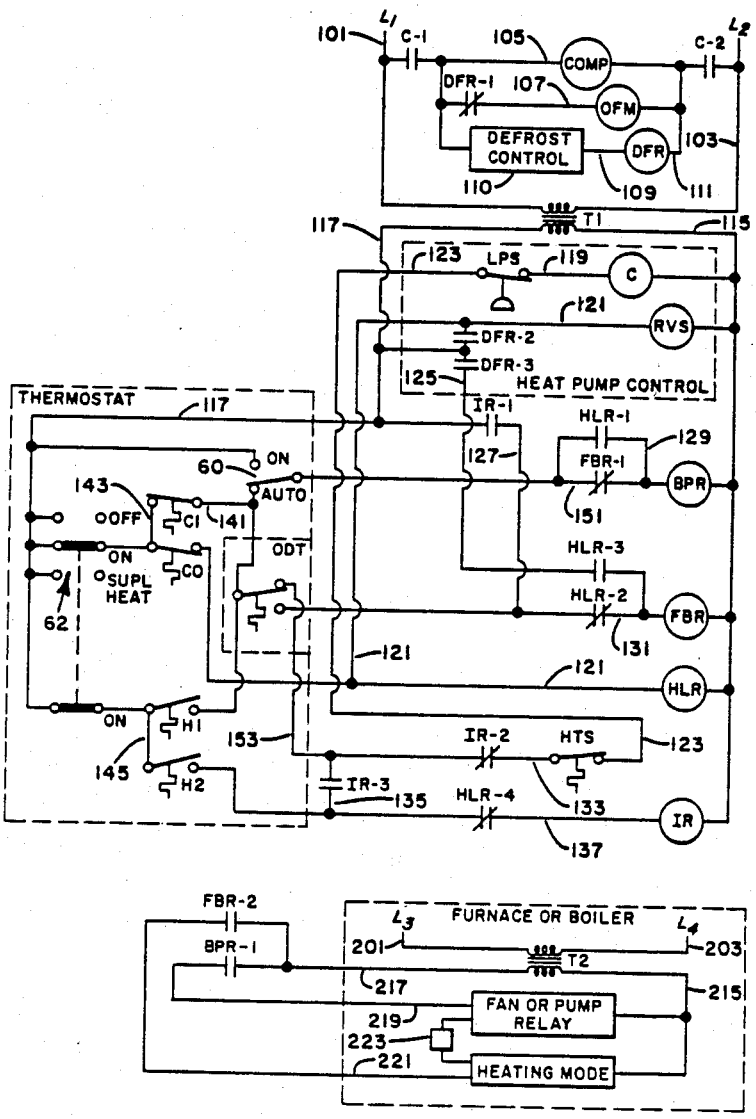
FIG. 2 is a schematic wiring diagram of the integrated control circuit.

Referring now to FIG. 2 there can be seen a schematic wiring diagram of the control circuit of the entire system. This schematic is broken into segments with dotted lines labeled "heat pump control", "ODT" (outdoor thermostat) and "furnace or boiler". The remainder of the circuit is essentially an integrated controls arrangement for connecting these various components.

Power is supplied to the control circuit from lines L-1, L-2, L-3 and L-4. Line L-1 is referenced wire 101 and is connected to transformer T-1 and to normally open compressor contactor contacts C-1. Wire 103 connects line L-2 to transformer T-1 and to normally open compressor contactor contacts C-2. Wire 105 connects normally open compressor contactor contacts C-1 with the compressor motor, with normally closed defrost relay contacts DFR-1 and defrost control 110. Wire 107 connects normally closed defrost relay contacts DFR-1 with the outdoor fan motor. Wire 109 connects the defrost control 110 with the defrost relay DFR. Wire 111 connects the compressor motor, the outdoor fan motor and the defrost relay to normally open compressor contactor contacts C-2.

Referring now to the control circuit portion of the wiring schematic operated at reduced voltage generated through transformer T-1 it may be seen that wire 117 connects transformer T-1 to normally open defrost relay contacts DFR-2, to normally open defrost relay contacts DFR-3, to normally open interlock relay contacts IR-1, to fan switch 60 and to system switch 62 of the thermostat. Wire 115 connects transformer T-1 to compressor contactor C, reversing valve solenoid RVS, blower pump relay BPR, furnace boiler relay FBR, heating lockout relay HLR and interlock relay IR. Wire 119 connects low pressure switch LPS with compressor contactor C. Wire 123 connects low pressure switch LPS with high temperature sensor HTS. Wire 121 connects reversing valve solenoid RVS with normally open defrost relay contacts DFR-2, with heating lockout relay HLR and with the C0 thermal sensing element of the thermostat. Wire 125 connects normally open defrost relay contacts DFR-3 with normally open heating relay contacts HLR-3. (As used herein, furnace boiler relay refers to a relay for energizing either a furnace or boiler depending on the equipment involved. Likewise, reference to a blower pump relay refers to a relay for energizing either the furnace blower or the boiler pump.)

In the thermostat portion of the control circuit it can be seen that power may be supplied through wire 117 to fan switch 60 and to the system switch 62. The system switch is shown in the on position and power is supplied through the system switch to wire 143 to both the cooling sensing elements C0 and C1. Element C0 is designed to close first as the temperature of the enclosure rises. Temperature element C1 closes at a slightly higher temperature. Power is also supplied to the two heating sensing elements H1 and H2 through wire 145, heating sensing element H1 being designed to close at a first reduction in temperature of the enclosure and element H2 being designed to close on a second greater reduction in temperature of the enclosure. Wire 141 connects sensing element C1 to the automatic position of fan switch 60 and heating sensing element H1 to the automatic position of fan switch 60 as well as to the outdoor thermostat ODT. Wire 151 connects fan switch 60 to normally closed furnace boiler relay contacts FBR-1 and normally open heating lockout relay contacts HLR-1. Wire 121 connects the C0 sensing element to the heating lockout relay HLR and to reversing valve solenoid RVS. Wire 135 connects the second stage heating sensing element H2 with normally open interlock relay contacts IR-3 and normally closed heating lockout re-lay contacts HLR-4.

Referring now to that portion of the wiring diagram which is neither the heat pump control nor the thermostat nor the furnace or boiler control, it may be seen that wire 127 connects normally open interlock relay contacts IR-1 with normally closed heating relay contacts HLR-2 and with a terminal of outdoor thermostat ODT. This is the low temperature terminal of the outdoor thermostat indicating that the ambient temperature is below a selected level. The high temperature connection to the outdoor thermostat indicating that the ambient temperature is above that level is connected via wire 153 to normally open interlock relay contacts IR-3 and normally closed interlock relay contacts IR-2. Wire 129 connects normally open heating lockout relay contacts HLR-1 and normally closed furnace boiler relay contacts FBR-1 with blower pump relay BPR. Wire 131 connects normally closed heating lockout relay contacts HLR-2 and normally open heating lockout relay contacts HLR-3 with furnace boiler relay FBR. Wire 133 connects normally closed interlock relay contacts IR-2 with the high temperature sensor HTS. Wire 135 connects normally open interlock relay contacts IR-3 with normally closed heating lockout relay contacts HLR-4 and the second stage heating sensing element H2. Wire 137 connects normally closed heating lockout relay contacts HLR-4 with interlock relay IR.

Shown at the bottom of FIG. 2 is a separate schematic for the furnace or boiler portion of the heating system. It can be seen therein that power is supplied separately through lines L-3 and L-4 connected by wires 201 and 203 to the high voltage side of transformer T-2. Low voltage side of thermostat T-2 is connected via wire 217 to normally open furnace boiler relay contacts FBR-2 and to normally open boiler pump relay contacts BPR-1. Wire 215 connects the other side of transformer T-2 to the fan relay circuit and to the heating mode circuit. Wire 219 connects the fan or pump relay circuit to normally open blower pump relay contacts BPR-1. Wire 221 connects the heating mode circuit to normally open furnace boiler relay contacts FBR-2. Wire 223 connects the heating mode circuit to the fan relay circuit and may include a sensing element such as a bonnet or furnace temperature switch. Fan or pump relay typically includes two fan speed relays, one energized through blower pump relay contacts BPR-1 and one energized by the heating mode circuit.

OPERATION

Upon a first stage cooling need being sensed power is supplied from wire 117 through now closed thermostatic sensing element C0 energizing heating lockout relay HLR through wire 121 and also energizing reversing valve solenoid RVS to place the reversing valve in the cooling position. Heating lockout relay HLR changes heating lockout relay contacts HLR-1 to now being closed, changes HLR-2 contacts to being open, HLR-3 contacts to being closed and HLR-4 contacts to being open. By opening the HLR-4 contacts the interlocking relay is prevented from being energized. By closing the HLR-3 contacts the furnace boiler relay may be energized through the defrost relay contacts should the unit be placed in the defrost mode. By opening the HLR-2 contacts the furnace boiler relay may not be energized through the lower temperature level of the outdoor thermostat. By closing the HLR-1 contacts the blower pump relay BPR may be energized through the fan switch of the thermostat.

Upon a second stage cooling need being detected thermal sensing element C1 closes making a circuit from wire 117, through wire 143 and through wire 141 to fan switch 60 and through now closed heating lockout relay contacts HLR-1 to energize the blower pump relay to bring on the indoor fan if it is a furnace system. The C1 sensing element also energizes through wire 153 through wire 141 and the outdoor thermostat since the ambient conditions during the cooling mode of operation will be above the switching level of outdoor thermostat ODT. From wire 153 current flows through normally closed interlock relay contacts IR-2, through wire 133, through high temperature sensor HTS which will remain closed in cooling since the indoor coil is serving as an evaporator through wire 123, through low pressure switch LPS and through wire 119 to compressor contactor C. The compressor contactor C closes contacts C-1 and C-2 supplying power to the compressor motor COMP supplying power through the normally closed defrost relay contacts DFR-1 to the outdoor fan motor to run outdoor fan 35 and to the defrost control. The compressor of the heat pump is run in this manner until such time as the cooling need is satisfied. The heating lockout relay in this mode prevents the interlock relay from being energized thereby preventing the cooling mode of operation from being locked out and further opens the flow path to the furnace boiler relay such that the furnace boiler relay may not be energized in the cooling mode.

Should a first stage heating need be detected then thermal sensing element H1 will close supplying power through wire 141 to fan switch 60. Simultaneously therewith, power will be supplied through the outdoor thermostat and should the outdoor thermostat be in a position shown sensing a high outdoor temperature indicating it is desired to operate the heat pump to supply heat energy then power will be supplied through wire 153, through normally closed interlock relay IR-2, through wire 133, through high temperature sensor HTS and through wire 123 and low pressure switch LPS to energize compressor contactor C. As in the cooling mode of operation when compressor contactor C closes, the compressor and outdoor fan motor are operated and the defrost control is energized. Upon a predetermined time interval and specific defrost thermostat temperature sensed through a defrost thermostat the defrost control as is known in the art acts to energize the defrost relay to place the unit in defrost. Otherwise, compressor operation is similar to the operation in the cooling mode. Note that the high temperature sensor HTS is connected in the circuit such that should the high temperature sensor detect a high temperature indicative of simultaneous operation of the heat pump and furnace it will open preventing operation of the compressor of the heat pump.

Should the defrost control detect a defrost need then defrost relay DFR is energized opening normally closed DFR-1 contacts thereby de-energizing the outdoor fan motor relay and the outdoor fan motor. Defrost relay contacts DFR-2 are closed supplying power to the reversing valve solenoid to place the unit in the cooling mode such that heat energy is supplied to the outdoor coil for heating same. Simultaneously, power is supplied through wire 121 not only to the reversing valve solenoid but also to heating lockout relay HLR. With the heating lockout relay energized the normally open heating relay contacts HLR-3 are closed. This allows a circuit to be made through now closed defrost relay contacts DFR-3 and through wires 125 and 131 to energize furnace boiler relay FBR for energizing the furnace or boiler by closing furnace boiler relay contacts FBR-2. This energizes the furnace or boiler in the heating mode such that heat energy is supplied to the enclosure from the furnace when the heat pump is being operated in the defrost mode.

Should a first stage heating need be sensed and should the outdoor thermostat detect that the furnace is a more appropriate heat source than the heat pump then the outdoor thermostat switches and power is supplied through wire 141, through wire 127, through normally closed heating lockout relay contacts HLR-2 and through wire 131 to the furnace boiler relay FBR to energize the furnace or boiler in the heating mode through the normally open furnace boiler relay contacts FBR-2. Hence, the furnace or boiler is operated in the heating mode by energization of the furnace boiler relay FBR. The heating lockout relay is not energized in this condition since the unit is not in cooling and hence power may be supplied from the first stage sensing element H1 to energize furnace boiler relay FBR.

Should a second stage heating need be sensed thermal sensing element H2 closes energizing through wire 135, through heating lockout relay contacts HLR-4 and through wire 137 to interlock relay IR. Once interlock relay IR is energized normally open interlock relay contacts IR-3 are closed and normally closed interlock relay contacts IR-2 are open. By closing the IR-3 contacts as long as a first stage heating need is sensed by element H1 being closed and if the outdoor thermostat in response to the ambient temperature selects heat pump operation rather than the furnace operation, then power is supplied through wire 141, through outdoor thermostat ODT, through wire 153, through the now closed interlock relay contacts IR-3, through wire 135, through closed heating lockout relay contacts HLR-4 and through wire 137 to keep the interlock relay IR energized even if second stage heating sensing element H2 opens. The heat pump compressor is de-energized since the IR-2 contacts are open preventing power from energizing compressor contactor C.

In second stage heating the normally open interlock relay contacts IR-1, connected to wire 117, close energizing through wire 127, through the closed heating relay contacts HLR-2, and through wire 131 the furnace boiler relay such that the furnace or boiler is operated. Should the second stage heating need be satisfied power will be supplied through first stage sensing element H1 either directly to the furnace boiler relay if the outdoor thermostat senses low ambient temperature or will remain energized through the interlock relay contacts IR-3 if the outdoor thermostat senses high outdoor temperatures. Hence, once the furnace is energized in second stage heating, the furnace is operated until both heating stages are satisfied.

The furnace or boiler portion in the schematic is shown such that upon energization of the furnace boiler relay FBR the furnace boiler relay contacts FBR-2 are closed bringing the furnace or boiler on in the heating mode. Additionally, normally open blower pump relay contacts BPR-1 are shown for energizing the fan or pump relay of the furnace or boiler. This combination is provided such that when the heat pump is being operated the blower pump relay BPR is energized to directly energize the fan or pump relay of the furnace such that the indoor fan or pump is operated. When the compressor of the heat pump is not being operated the contacts are such that either the heating lockout relay contacts HLR-1 are open or if the furnace boiler relay FBR is energized indicating furnace operation then the normally closed furnace boiler relay contacts FBR-1 are open preventing operation of blower pump relay BPR. In this condition, the heating mode circuit together with the fan relay circuit shown as connected via wire 223 including a bonnet switch or furnace temperature switch act to operate the indoor fan based upon furnace conditions. Hence, a delay to allow the heat exchangers of the furnace to be heated at startup of the furnace and a delay to allow the heat exchangers to be cooled at the completion of furnace operation is provided. This arrangement may also allow the indoor fan to be operated at a first speed when the blower pump relay contacts BPR-1 are closed to energize the fan relay and at a second speed when the heating mode circuit through wire 223 energizes the fan. Hence, there are two separate circuits for energizing the fan, each of which may be set out to energize the fan at a separate speed. Typically, the fan may be set to operate in a higher speed during heat pump compressor operation and a the lower speed during furnace operation. By providing the switching of different power sources to the indoor fan relay it is also possible to achieve a delay in fan operation when the unit is switched from heat pump operation to furnace operation such that the furnace heat exchangers may come up to temperature prior to the fan circulating air in heat exchange relation therewith.

The furnace boiler relay contacts FBR-2 and the boiler pump relay contacts BPR-1 are shown as part of the low voltage control circuitry. In some applications it may be desirable to have these two contacts part of the power circuitry such that power to a boiler or furnace is supplied through these contacts when in the closed position.

As may be seen from the above description, the combination of the heating lockout relay and the interlock relay serve to isolate various portions of the circuit such that should various components fail the unit will still operate in the appropriate manner. The heating lockout relay contacts, if energized, prevent operation of the interlock relay. Additionally, the interlock relay, although not specifically locking out the heating lockout relay, is arranged such that the heating lockout relay may only be energized in the cooling mode of operation or during defrost which is the cooling mode of operation. Heating lockout relay contacts are utilized to control the operation of the blower pump relay in the cooling mode and to prevent operation of the furnace boiler relay in the cooling mode. Heating lockout relay contacts are also utilized to complete the circuit for defrost during heating such that the furnace boiler relay may be energized to supply heat energy to the enclosure during defrost of the heat pump system.

The interlock relay, when energized, serves to bring on the furnace through the furnace boiler relay and serves to lock out the heat pump through the normally closed interlock relay contacts IR-2. The interlock relay further serves to provide electrical connections such that the interlock relay remains energized until both stages of heating are satisified regardless of the temperature sensed by the outdoor thermostat In the alternative embodiment the high temperature sensor HTS-A is connected to interrupt power to transformer T-1 should simultaneous separate heating means and compressor operation be detected. When power is interrupted to the entire circuit neither the heat pump or separate heating means may be operated. Hence, the occupant of the enclosure is made aware of a malfunction since there is no heat energy being supplied to the space.

The invention has been described in detail with particular reference to a preferred embodiment thereof. It is to be understood by those skilled in the art that variations and modifications can be effected within the spirit and scope of the invention.

What is claimed is:

1. A control circuit for integrating and separating the operation of a heat pump including heating and defrost modes of operation and a separate heating means, the separate heating means including a circulator for circulating a heating fluid, the control circuit including a thermostat for sensing heating and cooling needs and an outdoor thermostat for selecting either the heat pump or the separate heating means for supplying heat energy to a space to be conditioned which comprises:

a heating lockout relay connected to the control circuit to be energized when the thermostat senses a cooling need or when the unit is operated in the defrost mode of operation, said heating lockout relay preventing operation of the separate heating means when the heat pump is operating in the heating mode of operation;

a furnace boiler relay connected to be energized in response to the thermostat sensing a first stage heating need and the outdoor thermostat selecting furnace boiler operation and the heating lockout relay not being energized; and a circulator relay connected to a fan energization switch of the thermostat for being energized either when the furnace boiler relay is not energized or when the heating lockout relay is energized such that the circulator relay is energized with the energization of the heat pump and not energized with the operation of the separate heating means.

2. The apparatus as set forth in claim 1 and further comprising an interlock relay connected through normally closed heating lockout relay contacts to the thermostat means such that the interlock relay may be energized upon the thermostat detecting a second stage heating need and the heating lockout relay not being energized.

3. The apparatus as set forth in claim 2 and further comprising:

electrical connection means including normally open interlock relay contacts between the outdoor thermostat and the interlock relay such that the interlock relay will remain energized through now energized interlock relay contacts keeping the furnace boiler relay energized after the second stage heating need has been satisfied such that the separate heating means remains energized and the heat pump de-energized until both the first and second stage heating needs are satisfied.

4. The apparatus as set forth in claim 3 and further comprising:

electrical circuit means connecting the outdoor thermostat to the compressor for energizing the compressor when the ambient temperature is above a predetermined temperature, said electrical circuit means including a high temperature switch for sensing high refrigerant temperatures and normally closed interlock relay contacts such that the compressor may not be energized once a second stage heating need is satisfied until the interlock relay is de-energized, the interlock relay being energized until both the first and second heating stages are satisfied.

5. A method of integrating the operation of a heat pump including a compressor and having heating and defrost modes of operation and a separate heating means to provide for fail safe operation of the separate heat source, the separate heating means including a circulator for circulating a heating fluid to the enclosure to be conditioned, the control system for the separate heat sources including a thermostat for sensing heating and cooling needs and an outdoor thermostat for selecting either the heat pump or the separate heating means for supplying heat energy to a space to be conditioned which comprises the steps of:

energizing a heating lockout relay when the thermostat senses a cooling need for the space to be conditioned;

energizing the heating lockout relay when the heat pump is operated in the defrost mode of operation;

the step of energizing the heating lockout relay including preventing a furnace boiler relay from being energized through the outdoor thermostat such that the separate heating means is not operated when a cooling need is sensed;

the step of energizing the heating lockout relay including connecting a-circulator relay for energizing the circulator of the separate heating means to a fan switch in the thermostat; and the step of energizing the heating lockout relay including connecting defrost means to the furnace boiler relay for energizing the furnace boiler during the defrost mode of operation.

6. The method as set forth in claim 5 and further including an interlock relay for further separating control functions and further comprising the step of:

preventing the interlock relay from being energized when the heating lockout relay is energized.

7. The method as set forth in claim 6 and further comprising the step of energizing the furnace boiler relay when the interlock relay is energized to supply heating to the space via the separate heating means.

8. The method as set forth in claim 6 and further comprising the steps of:

energizing the interlock relay upon a second stage heating need being detected by the thermostat; and maintaining the interlock relay energized after the second stage heating need has been satisfied but before the first stage heating need has been satisfied such that the separate heating means remains energized until both the first and second stage heating needs have been satisfied.

9. The method as set forth in claim 8 and further comprising the step of preventing the compressor of the heat pump from being energized when the interlock relay is energized thereby preventing heat pump operation during periods of separate heating means operation.

* * * * *